US011506467B2

(12) United States Patent
Mayse

(10) Patent No.: US 11,506,467 B2
(45) Date of Patent: Nov. 22, 2022

(54) FIREARM HOLSTER DEVICE POSITIONED BETWEEN ADJACENT SURFACES AND RELATED METHODS

(71) Applicant: Maycon, LLC, Lake Wales, FL (US)

(72) Inventor: Patrick Jason Mayse, Lake Wales, FL (US)

(73) Assignee: MAYCON, LLC, Lake Wales, FL (US)

( * ) Notice: Subject to any disclaimer, the term of this patent is extended or adjusted under 35 U.S.C. 154(b) by 275 days.

(21) Appl. No.: 16/848,997

(22) Filed: Apr. 15, 2020

(65) Prior Publication Data

US 2020/0326153 A1 Oct. 15, 2020

Related U.S. Application Data

(60) Provisional application No. 62/833,837, filed on Apr. 15, 2019.

(51) Int. Cl.
*F41C 33/04* (2006.01)

(52) U.S. Cl.
CPC ..... *F41C 33/041* (2013.01)

(58) Field of Classification Search
CPC ..... F41C 33/041; F41C 33/04; F41C 33/06; A47C 21/00; A47C 21/08; A47C 21/022; A61G 7/0507; A61G 7/0518
See application file for complete search history.

(56) References Cited

U.S. PATENT DOCUMENTS

| | | | | |
|---|---|---|---|---|
| 4,483,501 | A * | 11/1984 | Eddy | F41C 33/0209 5/503.1 |
| 5,349,710 | A * | 9/1994 | Dunn | A61G 7/0503 5/503.1 |
| 6,704,955 | B1 * | 3/2004 | Jeffries | A47C 21/028 24/72.5 |
| 8,387,182 | B2 * | 3/2013 | Edelman | F41C 33/041 5/503.1 |
| 8,479,331 | B2 * | 7/2013 | Craighead | F41C 33/041 5/503.1 |
| 2011/0155775 | A1 | 6/2011 | Craighead | |

* cited by examiner

*Primary Examiner* — Corey N Skurdal
(74) *Attorney, Agent, or Firm* — Allen, Dyer, Doppelt + Gilchrist, PA

(57) ABSTRACT

A firearm holster device may be positioned between adjacent surfaces within a bed. The firearm holster device may include a first arm having a first major surface, and a second major surface opposing the first major surface. The first major surface may include protrusions extending transversely outward. The firearm holster device may include a second arm defining an opening pattern, a hinge coupled between the first arm and the second arm, and a holster received by the opening pattern and to receive a firearm. The first arm may be positioned between adjacent surfaces of the bed.

15 Claims, 7 Drawing Sheets

FIREARM HOLSTER DEVICE POSITIONED BETWEEN ADJACENT SURFACES AND RELATED METHODS

RELATED APPLICATION

This application is based upon prior filed Application No. 62/833,837 filed Apr. 15, 2019, the entire subject matter of which is incorporated herein by reference in its entirety.

TECHNICAL FIELD

The present disclosure relates to the field of firearm accessories, and, more particularly, to a firearm holster and related methods.

BACKGROUND

Firearms have been relevant to American culture since the American Revolution. Indeed, the right to bear firearms was included within the Bill of Rights during the formation of our current Constitution. Over the last two centuries, the firearms industry has developed into several silos or specialties: law enforcement and military, sportsman and recreational, and self-defense. Each of these specialties has also developed a large and robust associated firearm accessory industry. Firearm accessories include a large number of accessory types, including holsters, optics, cleaning tools, magazines, and firearms safes, for example.

The firearm holster is typically designed to offer protection to the handgun, secure its retention, and provide ready access to it. Indeed, the firearm holster is one of the more traditional accessories and dates back several centuries. The modern firearm holster industry is quite large and robust. In fact, there are many varying types of holster types, and each holster type has hundreds of available commercial options. For example, firearm holster types may include open-carry holsters, concealed-carry holsters, motor vehicle holsters, and under desk holsters, etc.

SUMMARY

Generally, a firearm holster device is to be positioned between first and second mattress surfaces within a bed. The firearm holster device may comprise a first arm having a first major surface, and a second major surface opposing the first major surface. The first major surface may include a plurality of protrusions extending transversely outward. The plurality of protrusions may extend into the first mattress surface of the bed, and the second major surface may abut the second mattress surface of the bed. The firearm holster device may comprise a second arm defining at least one opening pattern therein, a hinge coupled between the first arm and the second arm, and a holster received by the at least one opening pattern and to receive a firearm.

In particular, the hinge may be configured to switch the first arm and the second arm between a folded mode, and an extended mode. When in the extended mode, the first arm and the second arm may be canted at a substantially perpendicular angle.

In some embodiments, each protrusion may have a rectangle-box shape. Each rectangle-box shaped protrusion may be partially sunken in the first major surface, and canted with the first major surface. The at least one opening pattern may comprise a plurality of opening slot pairs. Each protrusion may comprise a flat facet facing the hinge, rounded upper corners extending from the flat facet, and a top surface being canted with respect to the first major surface. The top surface may be canted with respect to the first major surface at angle within a range of 5°-25°. The plurality of protrusions may comprise a group of aligned protrusions, and a group of offset protrusions.

Another aspect is directed to a method for making a firearm holster device to be positioned between first and second mattress surfaces within a bed. The method may include forming a first arm having a first major surface, and a second major surface opposing the first major surface. The first major surface may include a plurality of protrusions extending transversely outward. The plurality of protrusions may extend into the first mattress surface of the bed, and the second major surface may abut the second mattress surface of the bed. The method may comprise forming a second arm defining at least one opening pattern therein, coupling a hinge between the first arm and the second arm, and positioning a holster to be received by the at least one opening pattern and to receive a firearm.

DETAILED DESCRIPTION

Figure 1:
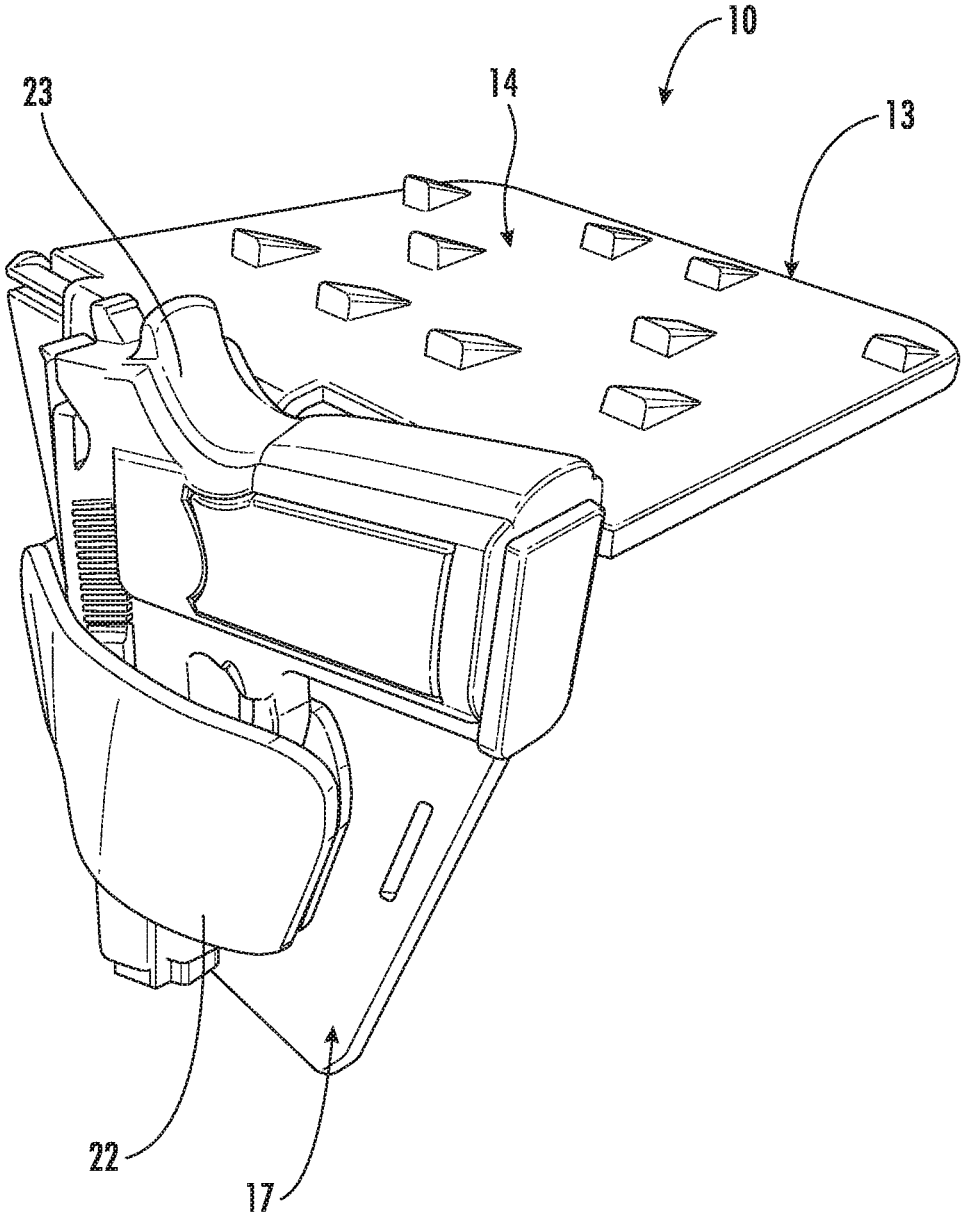
FIG. 1 is a perspective view of a firearm holster device with a firearm, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Referring to FIGS. 1-6, a firearm holster device 10 according to the present disclosure is now described. As perhaps best seen in FIG. 6, the firearm holster device 10 illustratively is to be positioned between adjacent first and second mattress surfaces 11, 12 (shown with dashed lines) within a bed. For example, in a typical application, the adjacent mattress surfaces 11, 12 may comprise opposing major surfaces of a mattress and a support (e.g. a box spring). Of course, the bed application is merely exemplary, and the firearm holster device 10 can be deployed in other applications.

The firearm holster device 10 illustratively includes a first arm 13 having a first major surface 14, and a second major surface 15 opposing the first major surface. The first major surface 14 illustratively comprises a plurality of protrusions 16*a*-16*j* extending transversely outward. The plurality of protrusions 16*a*-16*j* may extend into the first mattress surface 11 of the bed. The second major surface 15 abuts the second mattress surface 12 of the bed.

The firearm holster device 10 illustratively comprises a second arm 17 defining an opening pattern 20 therein. As perhaps best seen in FIG. 4, the opening pattern 20 illustratively includes multiple pairs of opposing slots to fit a wide array of fastening loops. The opening pattern 20 illustratively includes a pair of rectangle-shaped slots 27*a*-27*b*, each rectangle-shaped slot being substantially parallel (i.e. ±10°) to the other. The opening pattern 20 illustratively includes a first pair of curved-end slots 27*c*-27*d*, each first curved-end slot being substantially parallel (i.e. ±10°) with respect to the other, and a second pair of curved-end slots 27*e*-27*f*, each second curved-end slot being canted with respect to the other.

The firearm holster device 10 illustratively comprises a holster 22 received by the opening pattern 20 and to receive a firearm 23. Because of the multiple pairs of opposing slots, the firearm holster device 10 may accept the firearm 23 in multiple formats, such as a concealed firearm, or a full size firearm. Although not shown, the firearm holster device 10 comprises a plurality of loops to couple the holster 22 to the opening pattern 20.

Figure 3:
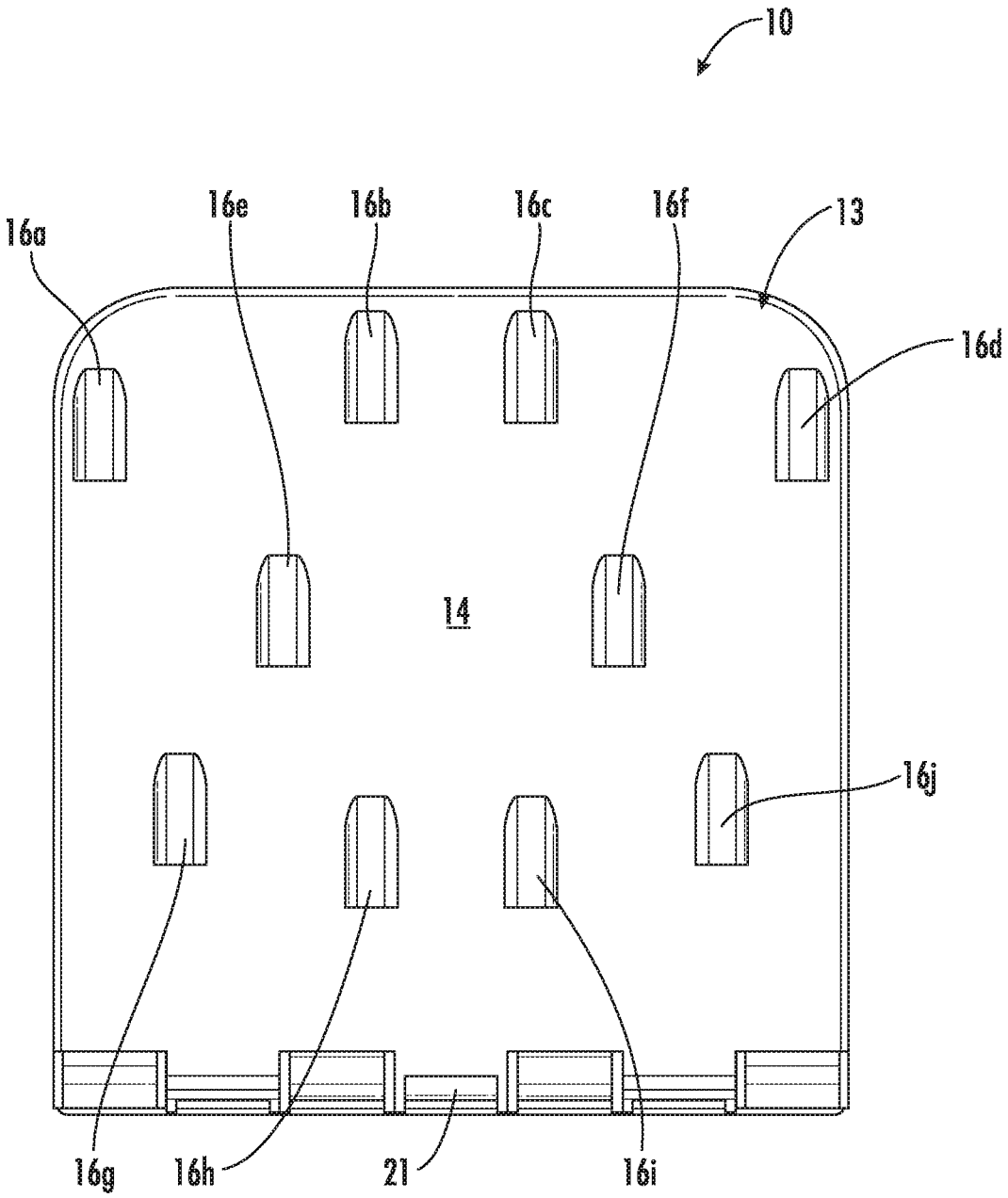
FIG. 3 is a schematic top plan view of the firearm holster device of FIG. 2A.
Figure 4:
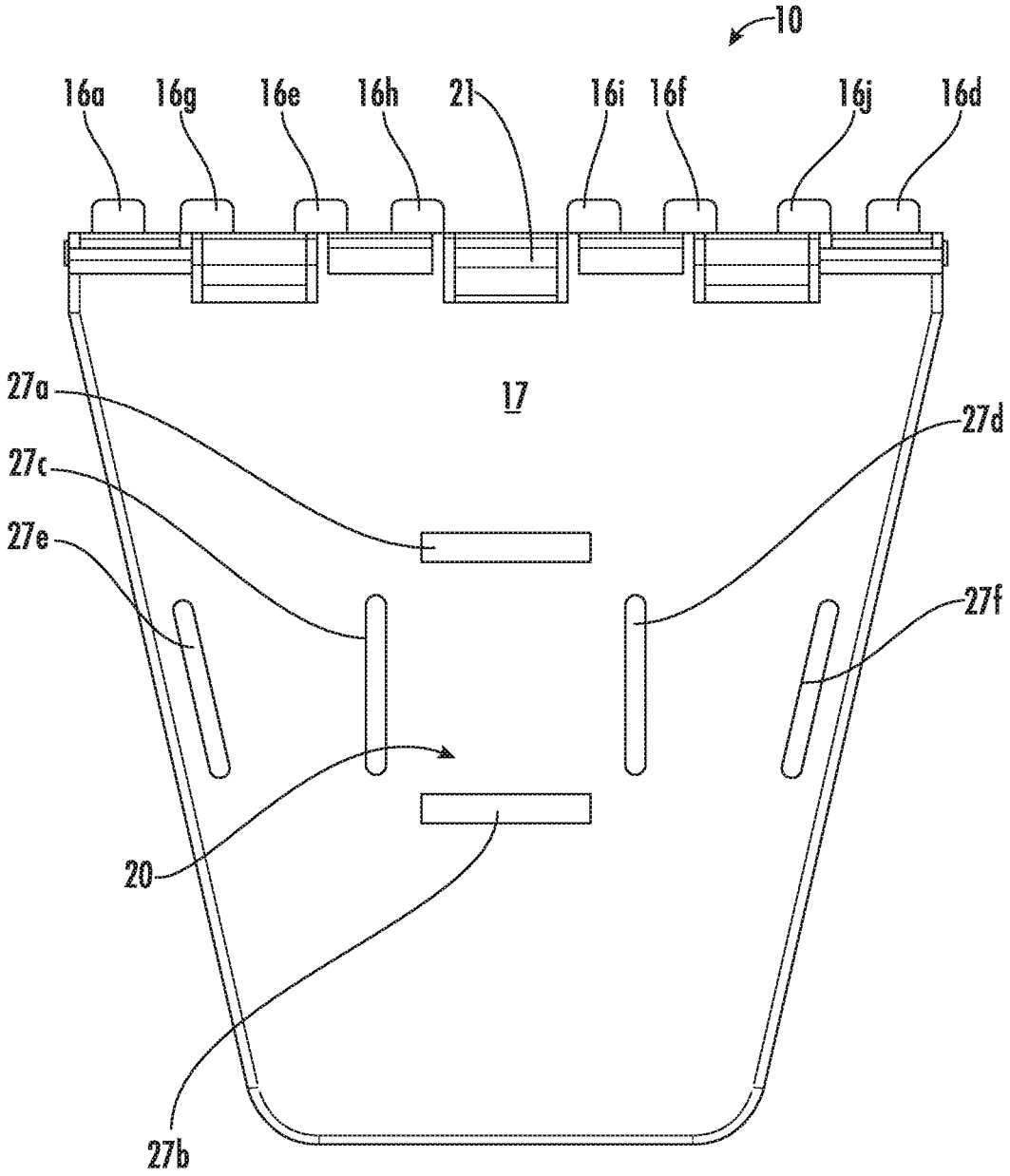
FIG. 4 is a schematic front side view of the firearm holster device of FIG. 2A.

As perhaps best seen in FIG. 3, the first arm 13 is illustratively square-shaped with rounded upper corners. As perhaps best seen in FIG. 4, the second arm 17 is illustratively trapezoid-shaped with rounded lower corners.

The firearm holster device 10 illustratively comprises a hinge 21 coupled between the first arm 13 and the second arm 17. The hinge 21 permits the firearm holster device 10 to be placed in a folded mode for storage, and placed in an extended mode for deployment/use. As perhaps best seen in FIG. 6, in the extended mode, the first arm 13 and the second arm 17 are angularly spaced apart at a substantially perpendicular angle, i.e. approximately 90° (i.e. 90°±10°). In some embodiments, the hinge 21 comprises a stop preventing further rotational movement of the second arm 17 from the first arm 13 beyond the 100° limit.

Figure 2A:
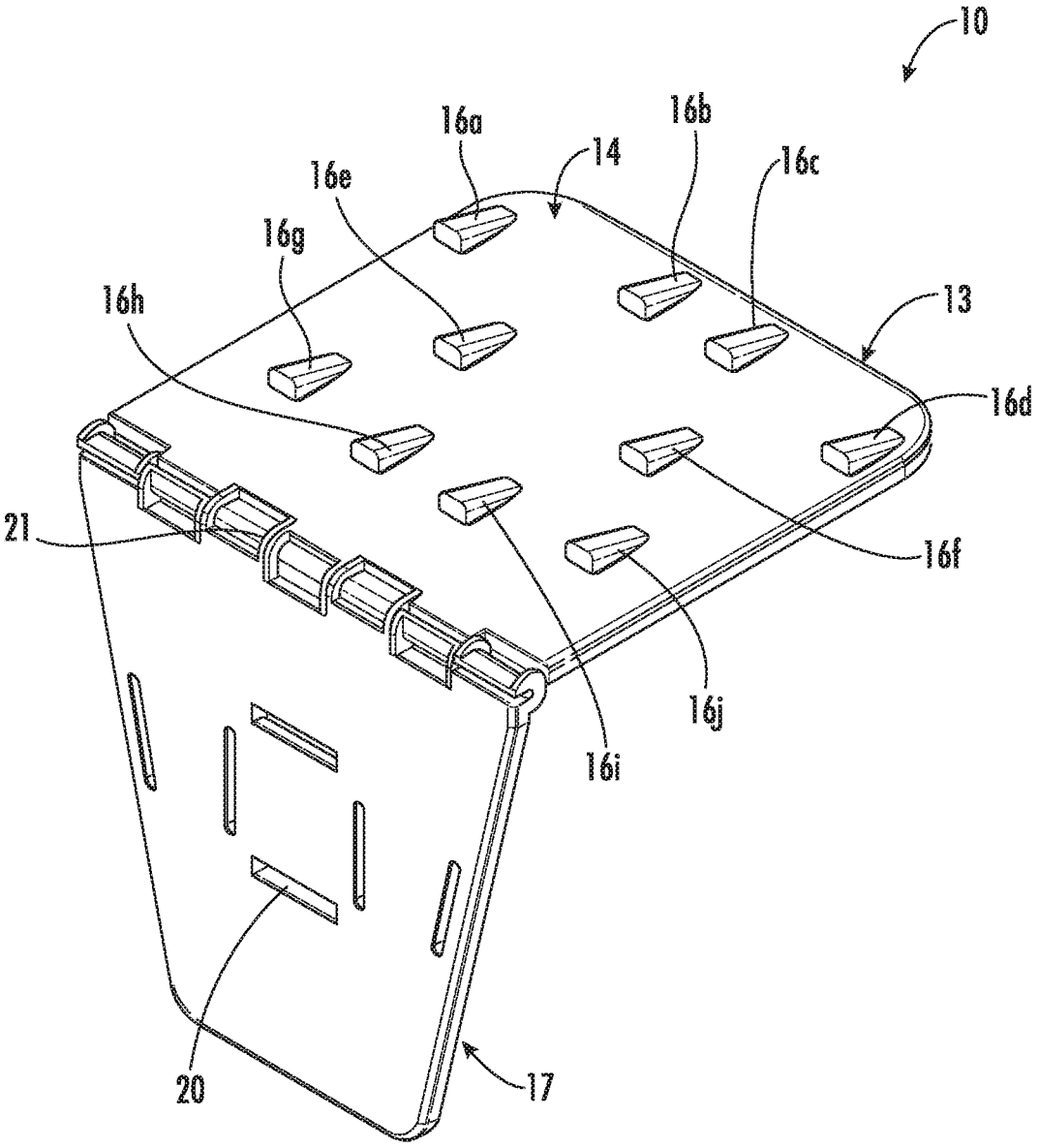
FIG. 2A is a schematic perspective view of the firearm holster device of FIG. 1 without the firearm and holster.
Figure 2B:
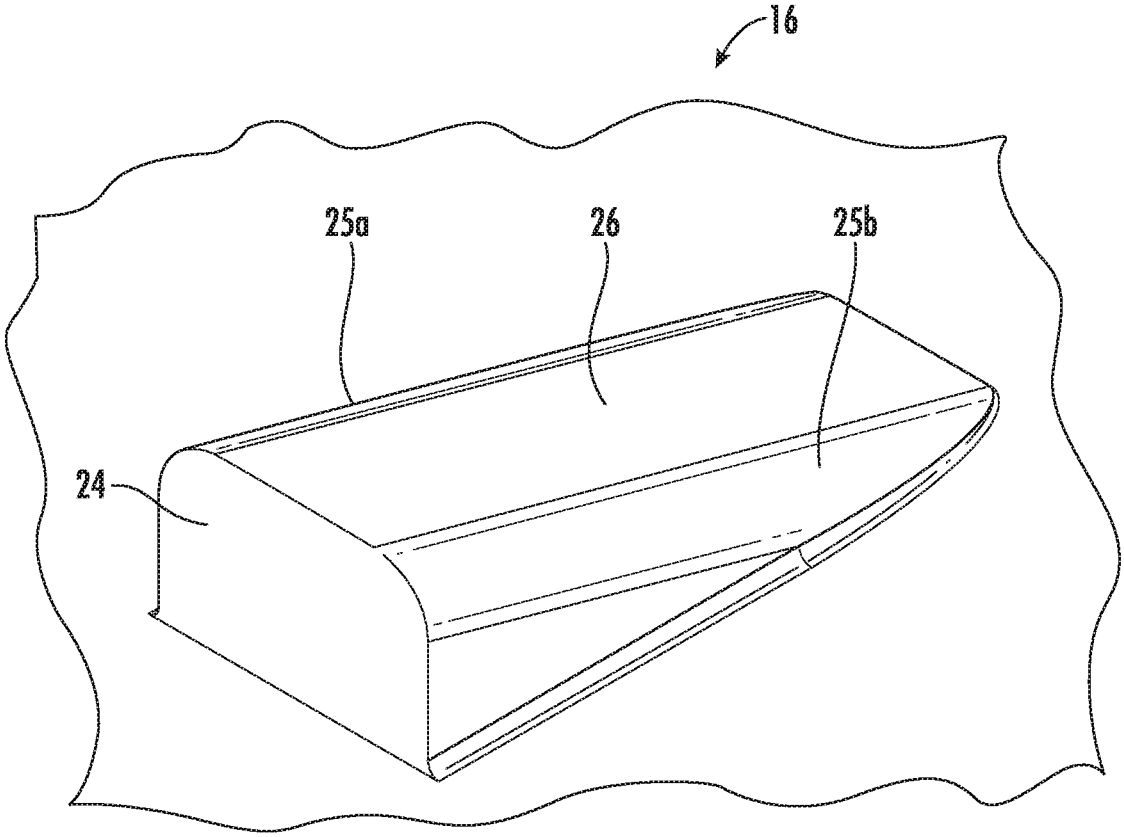
FIG. 2B is an enlarged schematic perspective view of a portion of the firearm holster device of FIG. 2A.

As perhaps best seen in FIG. 2B, each protrusion of the plurality of protrusions 16*a*-16*j* has a rectangle-box shape, which is partially sunken and canted with regards to the first major surface 14. Each protrusion of the plurality of protrusions 16*a*-16*j* comprises a flat facet 24 facing the hinge 21, rounded upper corners extending from the flat facet, and a top surface 26 being canted with respect to the first major surface 14 at approximately 15° (i.e. 15°±10°). In other embodiments, the cant of the top surface 26 may have a different angle value. As perhaps best seen in FIG. 3, the plurality of protrusions 16*a*-16*j* comprises a group of aligned protrusions 16*b*-16*c*, 16*e*-16*f*, 16*h*-16*i*, and a group of offset protrusions 16*a*, 16*d*, 16*g*, 16*j*.

Each protrusion of the plurality of protrusions 16*a*-16*j* comprises first and second longitudinal edges 25*a*-25*b*, which are also rounded. The rounding of the first and second longitudinal edges 25*a*-25*b* is helpful for reducing the risk of tearing, due to snags, the fabric in the adjacent mattress surfaces 11, 12 of the bed.

In the exemplary illustrated embodiment, the first arm 13 and the second arm 17 of the firearm holster device 10 comprise a polymer plastic material. In other embodiments, the first arm 13 and the second arm 17 of the firearm holster device 10 may comprise a metallic material. Indeed, any material that provides sufficient rigidity could be used. The holster 22 may comprise a plastic polymer or an organic natural material, such as leather.

In the extended mode, the first arm 13 may be positioned between adjacent mattress surfaces 11, 12 of the bed. Helpfully, the plurality of protrusions 16*a*-16*j* will retain the firearm holster device 10 between the adjacent mattress surfaces 11, 12 of the bed, and will resist lateral outward movement during retrieval of the firearm 23. In particular, this retention is due to the plurality of protrusions 16*a*-16*j* digging into the adjacent mattress surfaces 11, 12 of the bed and creating static frictional resistance.

Figure 5:
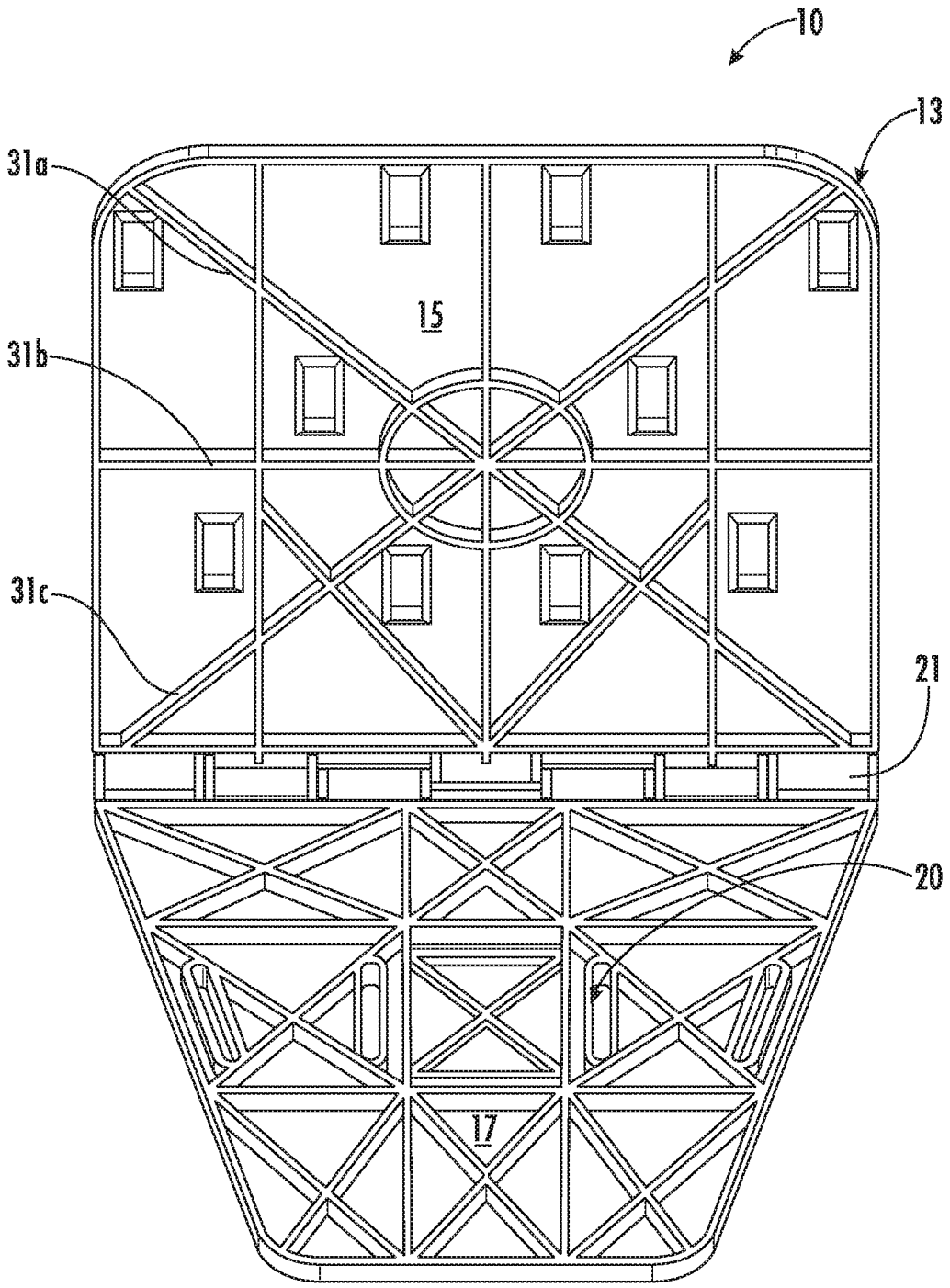
FIG. 5 is a schematic bottom perspective view of the firearm holster device of FIG. 2A.
Figure 6:
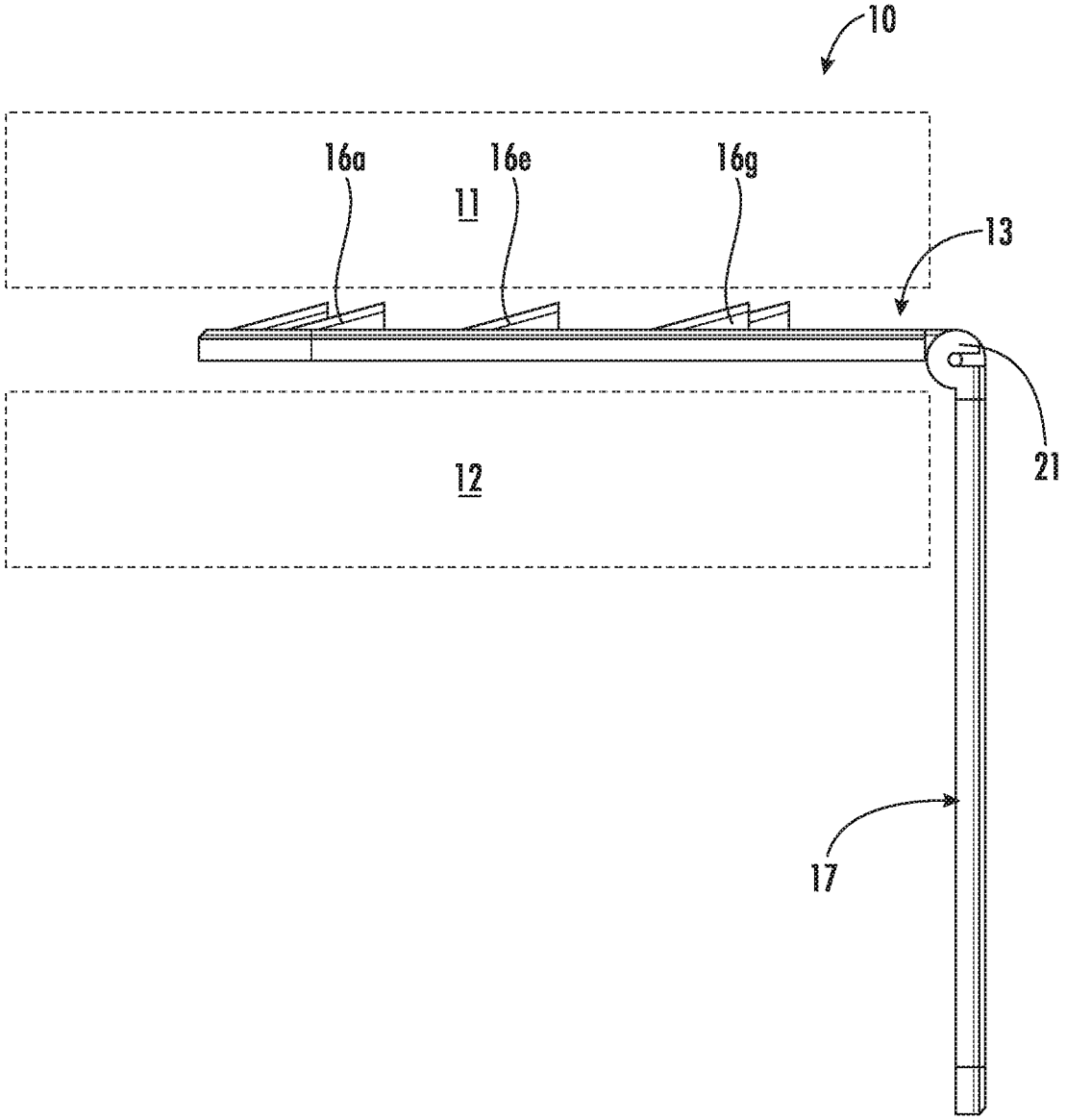
FIG. 6 is a schematic side elevational view of the firearm holster device of FIG. 2A.

As perhaps best seen in FIG. 5, the second major surface 15 comprises a plurality of ribs 31*a*-31*c* extending across thereon to provide structural rigidity. The second arm 17 similarly comprises a plurality of ribs for the same purpose.

Another aspect is directed to a method for making a firearm holster device 10 to be positioned between adjacent mattress surfaces 11, 12 within a bed. The method includes forming a first arm 13 having a first major surface 14, and a second major surface 15 opposing the first major surface. The first major surface 14 includes a plurality of protrusions 16*a*-16*j* extending transversely outward. The method comprises forming a second arm 17 defining an opening pattern 20 therein, coupling a hinge 21 between the first arm 13 and the second arm, and positioning a holster 22 in the opening pattern. The holster 22 receives a firearm 23, and the first arm 13 is positioned between adjacent mattress surfaces 11, 12 of the bed. In some embodiments, the forming steps each comprises an injection molding process with a thermoplastic material.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A firearm holster device to be positioned between first and second mattress surfaces within a bed, the firearm holster device comprising:

a first arm having a first major surface, and a second major surface opposing said first major surface, said first major surface comprising a plurality of protrusions extending transversely outward, said plurality of protrusions to extend into the first mattress surface of the bed, said second major surface to abut the second mattress surface of the bed;

each protrusion being rectangle-box shaped, partially sunken in said first major surface, and canted with respect to said first major surface;

a second arm defining at least one opening pattern therein;

a hinge coupled between said first arm and said second arm; and a holster received by said at least one opening pattern and to receive a firearm.

2. The firearm holster device of claim 1 wherein said hinge is configured to switch said first arm and said second arm between a folded mode, and an extended mode.

3. The firearm holster device of claim 2 wherein, when in the extended mode, said first arm and said second arm are canted at a substantially perpendicular angle.

4. The firearm holster device of claim 1 wherein said at least one opening pattern comprises a plurality of opening slot pairs.

5. The firearm holster device of claim 1 wherein each protrusion comprises a flat facet facing said hinge, rounded upper corners extending from said flat facet, and a top surface being canted with respect to said first major surface.

6. The firearm holster device of claim 5 wherein said top surface is canted with respect to said first major surface at angle within a range of 5°-25°.

7. The firearm holster device of claim 1 wherein said plurality of protrusions comprises a group of aligned protrusions, and a group of offset protrusions.

8. A firearm holster device to be positioned between first and second mattress surfaces within a bed, the firearm holster device comprising:

a first arm having a first major surface, and a second major surface opposing said first major surface, said first major surface comprising a plurality of protrusions extending transversely outward, said plurality of protrusions to extend into the first mattress surface of the bed, said second major surface to abut the second mattress surface of the bed;

each protrusion being rectangle-box shaped, partially sunken in said first major surface, and canted with respect to said first major surface;

a second arm defining at least one opening pattern therein;

a hinge coupled between said first arm and said second arm and configured to switch said first arm and said second arm between a folded mode, and an extended mode; and a holster received by said at least one opening pattern and to receive a firearm;

each protrusion comprising a flat facet facing said hinge, rounded upper corners extending from said flat facet, and a top surface being canted with respect to said first major surface.

9. The firearm holster device of claim 8 wherein, when in the extended mode, said first arm and said second arm are canted at a substantially perpendicular angle.

10. The firearm holster device of claim 8 wherein said at least one opening pattern comprises a plurality of opening slot pairs.

11. The firearm holster device of claim 8 wherein said top surface is canted with respect to said first major surface at angle within a range of 5°-25°.

12. The firearm holster device of claim 8 wherein said plurality of protrusions comprises a group of aligned protrusions, and a group of offset protrusions.

13. A method for making a firearm holster device to be positioned between first and second mattress surfaces within a bed, the method comprising:

forming a first arm having a first major surface, and a second major surface opposing the first major surface, the first major surface comprising a plurality of protrusions extending transversely outward, the plurality of protrusions to extend into the first mattress surface of the bed, the second major surface to abut the second mattress surface of the bed;

each protrusion being rectangle-box shaped, partially sunken in the first major surface, and canted with respect to the first major surface;

forming a second arm defining at least one opening pattern therein;

coupling a hinge between the first arm and the second arm; and positioning a holster to be received by the at least one opening pattern and to receive a firearm.

14. The method of claim 13 wherein the hinge is configured to switch the first arm and the second arm between a folded mode, and an extended mode.

15. The method of claim 14 wherein, when in the extended mode, the first arm and the second arm are canted at a substantially perpendicular angle.

* * * * *